United States Patent [19]

Braunberger

[11] Patent Number: 4,829,662

[45] Date of Patent: May 16, 1989

[54] BUTTON PRESS

[76] Inventor: Benjamin A. Braunberger, 300 Lost Arrow Rd., Rte. 2, Fond Du Lac, Wis. 54935

[21] Appl. No.: 74,690

[22] Filed: Jul. 17, 1987

[51] Int. Cl.[4] ..... B23P 11/00

[52] U.S. Cl. ..... 29/792; 29/243.52

[58] Field of Search ..... 29/243.52, 251, 792; 72/347, 452

[56] References Cited

U.S. PATENT DOCUMENTS

| | | | |
|---|---|---|---|
| 3,600,783 | 8/1971 | Krinsky et al. | 29/243.52 |
| 3,795,036 | 3/1974 | Roebuck | 29/243.52 |
| 4,696,086 | 9/1987 | Dickerson | 29/243.52 |

*Primary Examiner*—Timothy V. Eley
*Attorney, Agent, or Firm*—Quarles & Brady

[57] ABSTRACT

A button press has an indexable turntable on which are mounted a plurality of alternating lower forming die assemblies and crimping die assemblies. The lower die assemblies are positioned beneath an upper die assembly as the turntable is indexed. The upper die assembly is reciprocated towards and away from the lower die assemblies to first form a cover sheet and display sheet about a metal button front and then to join that subassembly to a metal back having a pin. The indexing of the turntable and the vertical reciprocation of the upper die assembly are provided by a single electric motor. The motor drives a sprocket which is mounted on a shaft leading to a right angle drive mechanism which converts the continuous rotation of the shaft into incremental rotary motion of the turntable. A vertical linkage extends from a face of the spracket to one end of a walking beam whose other end is connected to a ramrod that mounts the upper die assembly. A control for the electric motor allows continuous or intermittent incremental operation and includes switches that sense the position of the turntable to insure that the lower die assemblies are aligned beneath the upper die assembly when a press operation is to occur.

11 Claims, 6 Drawing Sheets

BUTTON PRESS

BACKGROUND OF THE INVENTION

This invention relates to button presses, and particularly to a machine for automatically assembling buttons.

Political campaign buttons and other similar display buttons that are pinned on the wearer are assembled from components that include: a metallic button back having the pin attached and with a formed rim; a button front in the form of a dish-shaped metallic disc having an extending peripheral flange which is adapted to be crimped about the rim of the back; a sheet of paper containing the message or other display; and a protective sheet of polyester film. During assembly, the paper sheet and polyester film are first formed about the button front. That assembly is then crimped about the back with the edges of the paper and protective film trapped between the front and back.

Buttons of this type are typically assembled on hand presses which include an upper die assembly that is pressed down upon alternate ones of a pair of lower die assemblies. One lower die assembly is used to form the paper and polyester film about the button front and the alternative die assembly is used to crimp the previously assembled front to the back.

Large scale industrial button presses are also available that mount the lower die assemblies on a turntable that is indexed beneath the upper die assembly. These industrial presses are large, expensive and unsuited for automated assembly of modest size lots of buttons.

The button press of the invention automates the assembly of the components in a simple, compact and efficient manner.

Summary of the Invention

A button press according to the present invention includes an upper die assembly that is mounted for vertical movement on a support, an indexable turntable mounting a plurality of spaced, alternating forming die assemblies and crimping die assemblies that are positionable beneath the upper die assembly as the turntable is indexed, means for moving the upper die assembly toward and away from engagement with a respective lower die assembly, means for indexing the turntable through finite increments to place alternate ones of the lower dies beneath the upper die assembly, and a common drive that provides coordinated reciprocal motion of the upper die assembly and indexing of the turntable.

The means for indexing the turntable preferably includes an index wheel mounted on a shaft which mounts the turntable. The index wheel includes a plurality of spaced radial slots in its perimeter. A drive roller connected to the common drive is movable thereby through a conical path that intersects the perimeter of the index wheel to engage successive radial slots and to advance the index wheel one increment for each complete orbit of the drive roller.

The operator of a button press in accordance with the present invention can load components on the lower die assemblies on the turntable and allow the components to be advanced underneath the upper die assembly as the turntable indexes. Completed buttons can be removed by the same operator from the die assemblies after exiting from beneath the upper die assembly.

The button press uses a single electric motor to both index the turntable and drive the upper die assembly towards and away from the respective lower die assembly. The button press includes a control for the electric motor which allows continuous operation, or intermittent incremental operation, and which also includes safeguards to insure that the dies are in proper alignment before the upper die assembly engages a lower die assembly.

It is a principal object of the invention to provide a compact, efficient and automatic button press for assembling the components of a button.

It is a further object of the invention to provide a button press in which a single drive source provides the incremental rotary indexing of a turntable carrying a plurality of lower die assemblies and at the same time provides the linear motion of an upper die assembly which is raised and lowered with respect to the lower die assemblies.

It is yet another object of the invention to provide a right angle drive mechanism which converts continuous rotary motion of a shaft into incremental rotary motion of a turntable.

The foregoing and other objects and advantages of the invention will appear in the detailed description which follows. In the description, reference is made to the accompanying drawings which illustrate a preferred embodiment of the button press.

BRIEF DESCRIPTION OF THE DRAWINGS

FIG. 10 is an exploded view in perspective of the components that form a completed button.

DETAILED DESCRIPTION OF THE PREFERRED EMBODIMENT

Figure 2:
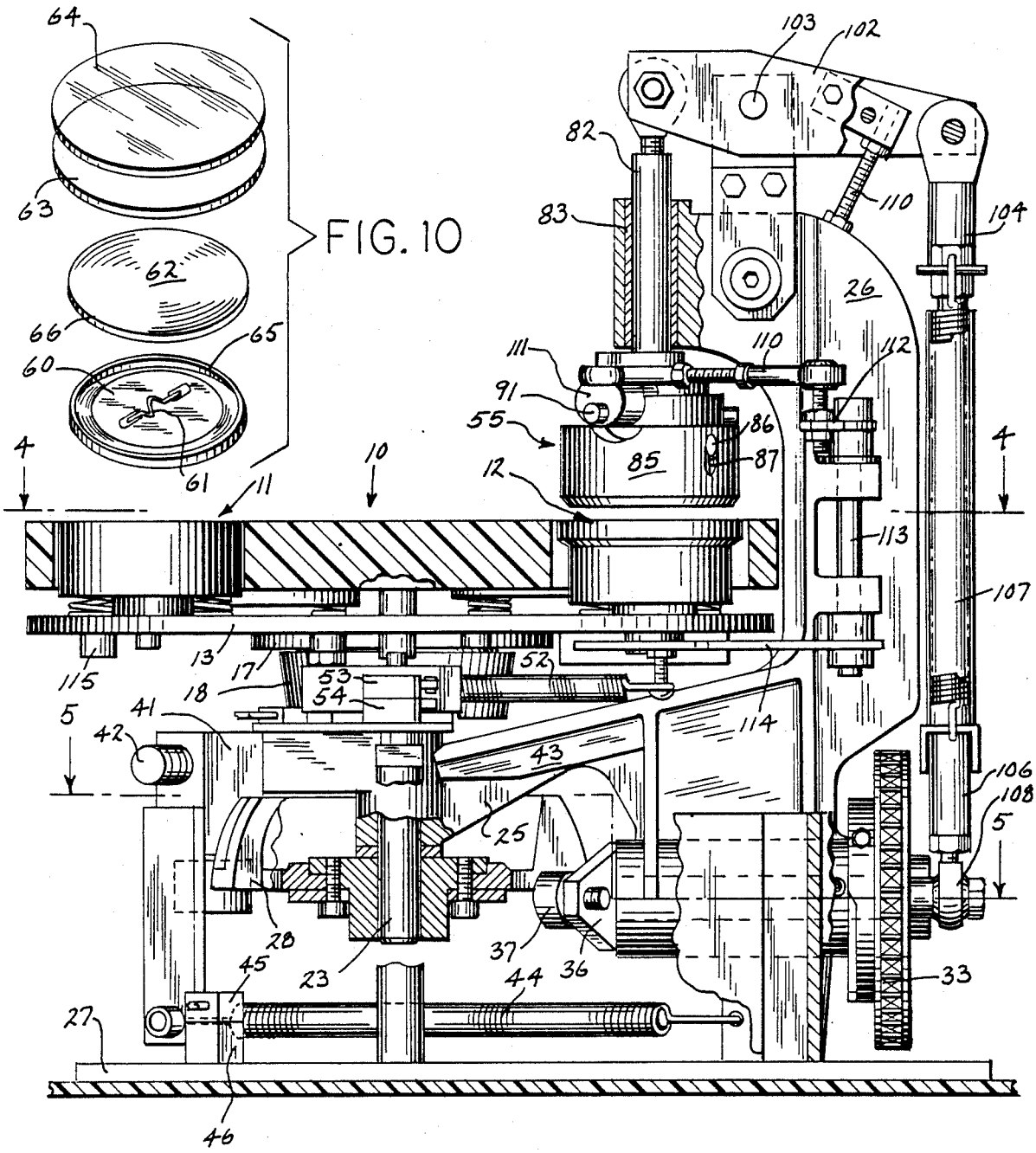
FIG. 2 is a side view in elevation of the button press with the outer housing removed and with portions broken away and in section for purposes of illustration.
Figure 3:
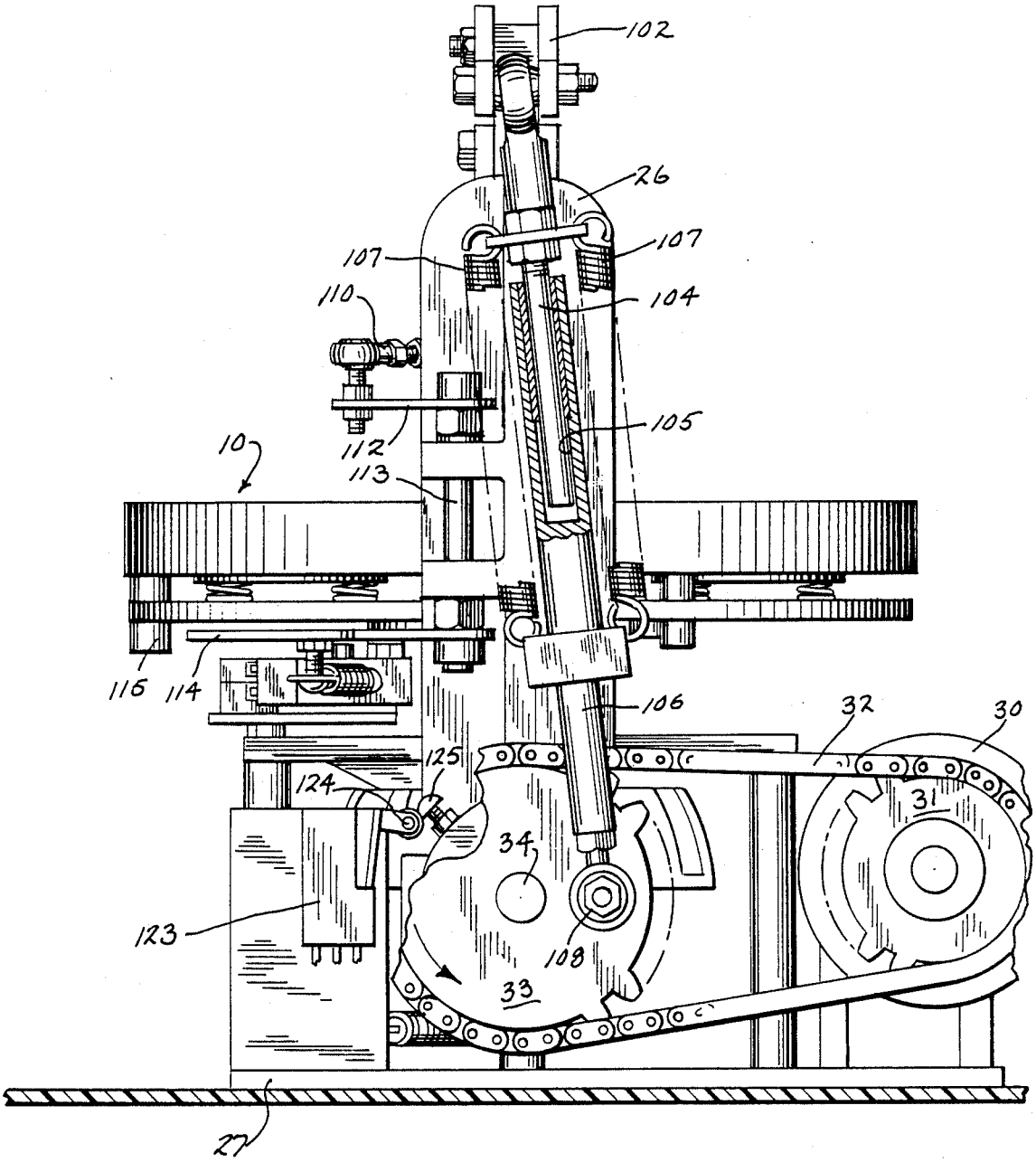
FIG. 3 is a rear elevation view similar to FIG. 2.

The button press includes an indexable horizontal turntable indicated generally by the reference numeral 10. The turntable 10 mounts sets of lower forming die assemblies 11 and lower crimping die assemblies 12. The lower die assemblies 11 and 12 are arranged alternately in a circular path upon the table 10. As shown in FIG. 2, the turntable 10 includes a lower platform 13 that mounts the lower die assemblies 1 and 12. An upper table platform 14 is mounted on and spaced from the lower platform and surrounds the die assemblies 11 and 12.

Figure 4:
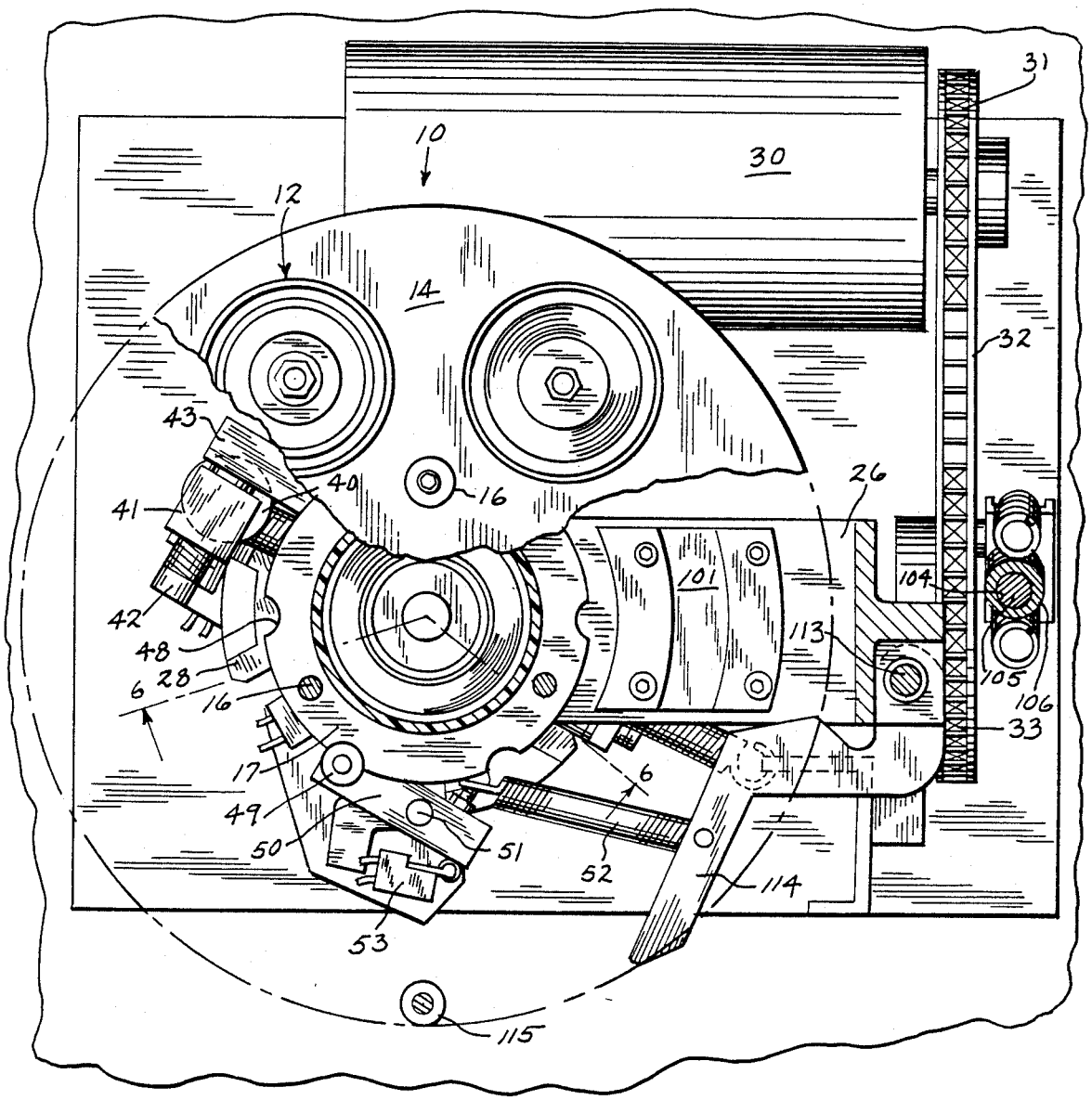
FIG. 4 is top plan view taken in the plane of the line 4—4 of FIG. 2 and with a portion of the turntable broken away to illustrate the mechanism beneath the table.
Figure 6:
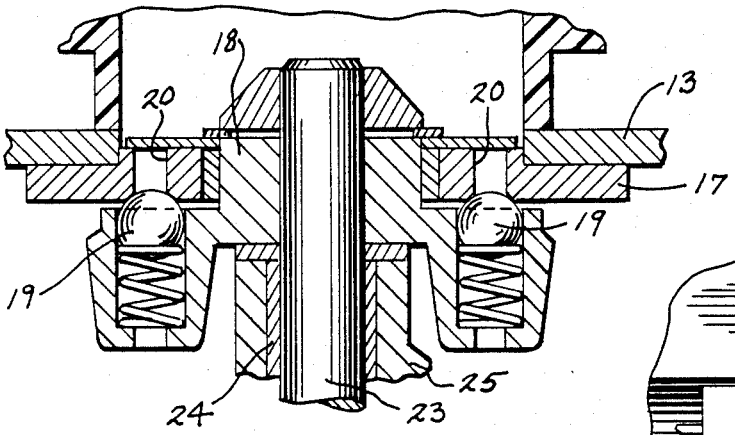
FIG. 6 is a view in section to an enlarged scale of the turntable hub mechanism and taken in the plane of the line 6—6 of FIG. 4.
Figure 7:
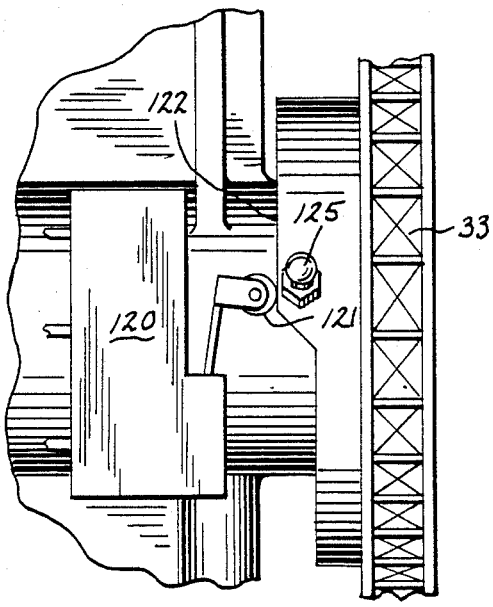
FIG. 7 is an enlarged view taken from the plane of the line 7—7 in FIG. 5 and showing a micro switch and switch actuator associated with the common drive.

As shown in FIGS. 4 and 6, the turntable 10 is connected by bolts 16 to a carrier ring 17 which is mounted to a hub 18 by a detent clutch assembly that includes a plurality of spring loaded balls 19 held in the hub 18 and normally engaging detent openings 20 in the carrier ring 17.

The hub 18 is mounted to the upper end of a vertical shaft 23 which is journaled intermediate its length in a sleeve bearing 24 mounted in a projecting arm portion 25 of a standard 26 which projects upwardly from a base plate 27 for the button press. The lower end of the shaft 23 mounts an index wheel 88. The turntable 10 is thereby mounted to rotate with the index wheel 28.

Figure 5:
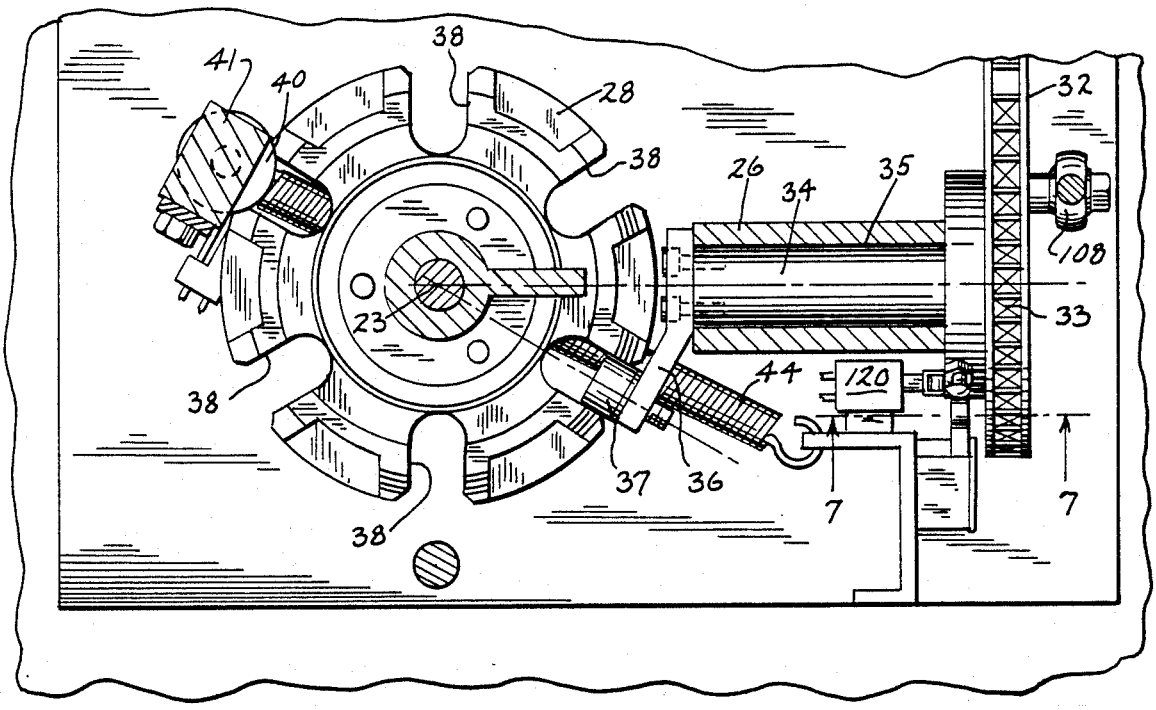
FIG. 5 is a top plan view taken in the plane of the line 5—5 in FIG. 2.

The index wheel 28 is driven by an electric motor drive 30 having an integral speed reducer and provided with an electronic start/stop. The output shaft of the motor drive 30 mounts a toothed sprocket 31 connected by a drive chain 32 to a driven sprocket 33 that is mounted to one end of a horizontal shaft 34 journaled in a sleeve bearing 35 mounted in the standard 26. The other end of the horizontal shaft 34 has a crank arm 36 that projects laterally from the axis of the shaft 34. The crank arm 36 mounts a drive roller 37 whose axis is at an angle to the axis of the horizontal shaft 34. As seen in FIG. 5, the axes of drive roller 37, of the horizontal shaft 34, and of the vertical shaft 23 intersect at a point.

The drive roller 37 is adapted to engage with spaced vertical slots 38 in the index wheel 28. The rotation of the horizontal shaft 34 will cause the drive roller 37 to sweep through a conical path. In so doing, the drive roller 37 will engage first the bottom of a slot 38 and then travel up through the slot 38 thereby rotating the index wheel 18. The index wheel 28 is advanced one-sixth of a revolution for each complete revolution of the horizontal shaft 34 and of the drive roller 37.

A detent roller 40 is mounted in a block 41 that is pivoted on a horizontal pivot pin 42 to a projecting arm 43 of the standard 26. The bottom end of the block 41 is connected to a tension spring 44 such that the detent roller 40 is urged under the force of the spring 44 to engage the slots 38 in the index wheel 28. This helps to insure that the index wheel 28 will be advanced only one increment at a time by the drive roller 37 since each rotation of the index wheel 28 must overcome the heavy spring force exerted on the detent roller 40. The movement of the lower end of the block 41 as the detent roller 40 is forced out of a slot 38 and the subsequent return to a slot 38 in the index wheel 28 is sensed by a pair of index detent micro switches 45 and 46.

A position sensing mechanism is provided in association with the turntable 10. As shown in FIG. 4, the carrier ring 17 has six semicircular detent recesses 48 in its outer perimeter and a detent roller 49 rides the perimeter and is adapted to engage the detent recesses 48. The roller 49 is mounted on a block 50 that is in turn mounted on a vertical pivot pin 51. The block 50 is urged by a tension spring 52 to a position in which the roller 49 engages the perimeter of the carrier ring 17. The block 50 engages a pair of table position micro switches 53 and 54 that are actuated upon the engagement of the roller 49 in a detent recess 48. The switches 53 and 54 thereby sense the index position of the table 10.

The mechanism thus far described will cause the turntable 10 to be indexed through one-sixth of a revolution at a time to precisely present alternative ones of the lower die assemblies 11 and 12 to a position directly beneath an upper die assembly 55 which cooperates with each of the lower die assemblies 11 and 12 to assemble a button.

FIG. 10 shows the components of the typical button. They include a metal back 60 mounting a safety pin 61, a metal front 62, a display disc 63 usually made of paper, and a clear plastic cover sheet 64 of a polyester film. The back 60 has a formed rim 65 and the front 62 is dish-shaped and has a rearwardly extending flange 66. In assembling the components to form a completed button, the clear cover 64 and the display disc 63 are first placed over the front 62, and the cover 64 and display 63 are formed about the front 62 with the edges of the cover 64 and display 63 extruded about the flange 66 of the front 62. Such subassembly is then attached to the back 60 by crimping the edges and the flange 66 about the rim 65 of the back 60. This two-stage assembly operation is accomplished first by use of the forming die assembly 11 to create the subassembly and thereafter by use of the crimping die assembly 12.

Figure 9:
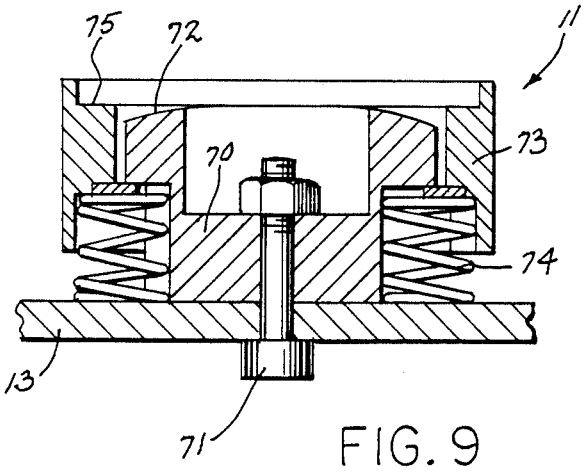
FIG. 9 is a view in vertical section similar to FIG. 8 but taken through the lower forming die assembly.

Referring to FIG. 9, each forming die assembly 11 has a central plug 70 that is attached to the lower platform 13 of the table 10 by a headed bolt 71. The upper surface 72 of the plug 70 has a convex shape which matches the concave shape of the front 62 of a button. A forming die ring 73 surrounds the plug 70 and is urged to an upper position by a plurality of compression springs 74. The forming die ring 73 has an annular shelf 75 which supports the flat, unformed display disc 63 and clear cover 64, while the dish-shaped front 62 is supported on and conforms to the convex surface 72 of the plug 70.

Figure 8:
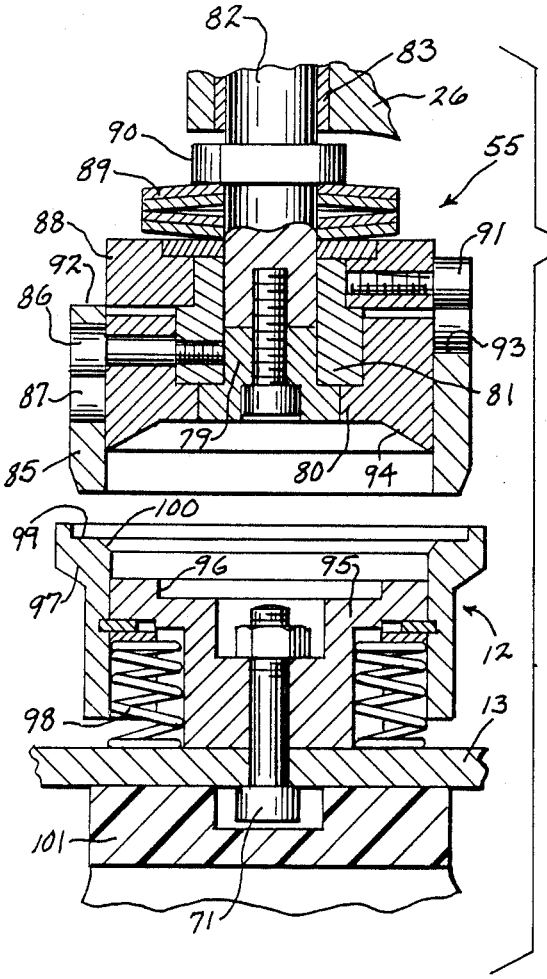
FIG. 8 is a view in vertical section through the upper die assembly and lower crimping die assembly.

As shown in FIG. 8, the upper die assembly 55 includes a central plug 80 connected about a hub 81 that is held in place by a retainer 79 bolted to the end of a vertical ramrod 82 that is journaled in a sleeve bearing 83 mounted in a vertical bore of the standard 26. An upper die ring 85 surrounds the plug 80 and is mounted thereto by a plurality of bolts 86 whose heads are received in elongated slots 87 in the ring 85. The ring 85 is therefore able to slide up and down with respect to the plug 80 within the limits of the slot 87. The bolts 86 also attach the plug 80 to the hub 81. A shifter ring 88 surrounds the hub 81 at a level above the upper die ring 85. The shifter ring 88 is disposed against a stack of Bellville springs 89 that are between the upper surface of the shifter ring 88 and a flange 90 formed integral with the ramrod 82. A small amount of downward motion of the ramrod 82 can be absorbed by the springs 89 if more than one button component is inadvertently placed in the die thereby preventing the die from closing completely.

The shifter ring 88 has a series of three projecting screws 91 whose heads bear upon the upper edge 92 of the upper die ring 85. This upper edge 92 has three semicircular recesses 93 equally spaced about its perimeter. The central plug 80 has a conical lower surface 94.

Also as shown in FIG. 8, each crimping die assembly 12 includes a central plug 95 that is bolted to the lower platform 13 of the table 10 by a headed bolt 71, and which has a central recess 96 to accommodate the pin 61 of the button back 60. A crimping die ring 97 surrounds the plug 95 and is biased away from the lower platform 13 by compression springs 98. The ring 97 has a recessed shelf 99 and an inclined surface 100 extending from the shelf 99 to the inner bore of the ring 97.

In operation, a dished front 62 is placed in a forming die assembly 11 against the convex surface 72 and a display disc 63 and cover 64 are placed on the shelf 75.

The upper die assembly 55 is then brought down upon the forming die assembly 11 to form the display disc 63 and cover 64 about the metal front 62. This is accomplished by operating the upper die plug 80 and ring 85 as a unit such that the ring 85 does not slide relative to the plug 80. Instead, the ring 85 will first engage the shelf 75 forcing the forming ring 73 of the lower die down against the compression springs 74. The cover 64 and display disc 63 will be engaged by the front 62 through the relative upward motion of the convex surface 72 as the springs 74 compress during the downward travel of ring 73 as urged by the sleeve 85. At the limit of this travel, the cover 64 and display disc 63 will have been drawn from the shelf 75 and conformed to the front 62 and its flange 66 with a substantial skirt portion projecting cylindrically below the flange 66. A the upper die 55 and lower die 11 separate during the final portion of the press forming cycle, the cover 64, display disc 63 and front 62 are retained by friction inside the lower cylindrical surface of the sleeve 85 adjacent the conical surface 94 on the plug 80.

When the upper die 55 with the button front subassembly subsequently encounters a crimping die assembly 12, the sleeve 85 will be allowed to move independently of the plug 80 with the result that the sleeve 85 first encounters the shelf 99 of the crimping die ring 97 and loses motion while the central plug 80 of the upper die 55 forces the button front subassembly out of the sleeve 85. The extended skirt portion of the display disc 63 and cover 64 is turned inward by the inclined surface 100 in the ring 97 as the subassembly is expelled from the sleeve 85 by the conical surface 94 of the plug 80. When the lower extreme of the flange 66 on the metal front 62 reaches the inclined surface 100, the upward bias of springs 98 on ring 97 is overcome and allows upward motion of the plug 95 relative to the ring 97 to force the back 60 into the front 62 thereby trapping the skirt portion of the display and cover between the front and back. Upon further downward travel, the lower end of the sleeve 97 reaches its limit at the platform 13. Further downward travel allows the conical surface 94 of plug 80 to force the flange 66 on the front 62 to turn inward add conform to the inclined surface 100 capturing the rim 65 of the back 60 inside the front.

The turntable 10 and the lower die assembly 11 or 12 positioned beneath the upper die assembly 55 are supported against a block 101 mounted on the standard 26 and having a central recess to accommodate the heads of the mounting bolt 71.

The mechanism that reciprocates the upper die assembly 55 relative to the lower die assemblies 11 and 12, and which controls the position of the ring 85 relative to the plug 80 of the upper die assembly will now be described.

The ramrod 82 is pivotably connected at its top through a spherical bearing to one end of a walking beam 102 that is pivoted intermediate its ends on a pivot pin 103 attached to an extension of the standard 26. The opposite end of the walking beam 102 is connected through a spherical bearing to an upper connecting rod 104 which is telescopically received in a counter bore 105 in a lower connecting rod 106. The upper and lower connecting rods 104 and 106 are urged to move in unison by a pair of tension springs 107 which are connected respectively at their ends to the upper and lower rods 104 and 106. The lower connecting rod 106 is connected at a spherical bearing 108 to the face of the driven sprocket 33 at a position spaced from the axis of the horizontal shaft 34. Accordingly, rotation of the driven sprocket 33 will not only be translated into rotation of the index wheel 28, but will also be translated into linear motion of the upper and lower connecting rods 104 and 106 and, through them, will be translated into a rocking motion of the walking beam 102. The rocking of the walking beam 102 will cause the ramrod 82 to reciprocate up and down and thereby will bring the upper die assembly 55 into and out of engagement with the respective lower die assemblies 11 and 12. The reciprocating or pressing motion occurs during that portion of a full revolution of the drive sprocket 33 when the bearing 108 is traveling above a horizontal line through the center of the sprocket 33. Telescoping connecting rods 104 and 106 permit lost motion during the remaining portion of a revolution of the sprocket 33, during which time indexing is taking place. The springs hold the upper die 55 at its upper limit of travel during the lost motion function.

An adjustable screw 110 can bear against an upper end of the standard 26 to act as a stop against excessive upper movement of the ramrod 82 and of the upper die assembly 55 which it mounts.

The position of the upper die ring 85 in relation to the upper die plug 80 is controlled by the relative angular position of the shifter ring 88. In one position of the shifter ring 88, the bolt heads 91 will bear upon the upper edge 92 of the upper die ring 85. In that position the die ring 85 cannot move independently of the plug 80. That is the position used when cooperating with a forming die assembly 11. The shifter ring 88 may be moved angularly to a second position in which the heads of the screws 91 are disposed in alignment with the recesses 93 in the upper edge 92. In that position, the plug 80 is free to move axially relative to the ring 85 until the heads of the screws 91 reach the bottoms of the recesses 93. That is the condition required when the upper die assembly 55 is cooperating with a crimping die assembly 12.

The shifter ring 88 is moved rotationally between its two positions by an upper shift link 110 that is connected via a spherical bearing at one end to a block 111 on the shifter ring 88 and is connected at its other end to an upper crank arm 112 extending laterally from a shifter pivot shaft 113 which is held in bearings on the side of the standard 26. The bottom of the shifter pivot shaft 113 mounts a lower crank arm 114 that extends in the path of travel of three spaced rollers 115 which depend from beneath the lower platform 13 of the table 10. As shown in FIG. 4, the lower crank arm 114 is urged to an inward position by the spring 52. However, when engaged by a roller 115 as the table is indexed, the lower arm 114 is moved thereby rotating the pivot shaft 113 and moving the shifter ring 88 to a position where the bolt heads 91 are aligned with the recesses 93. That motion will occur as the turntable 10 is indexed to present a crimping die assembly 12 to the position beneath the upper die assembly 55.

The relative angular position of the driven sprocket 33, and therefore the positions of the drive roller 37 in its cycle of rotation and of the ramrod 82 in its reciprocation, are sensed by two switches. A press-index switch 120 has its switch actuator 121 riding a cam surface 122 formed along the rear of the hub of the driven sprocket 33. An end-of-cycle switch 123 has its switch actuator 124 in the path of a screw head 125 and a second screw head (not shown) 180° away. Both screw heads extend radially from the hub of the sprocket 33 adjacent to the cam surface 122.

Figure 1:
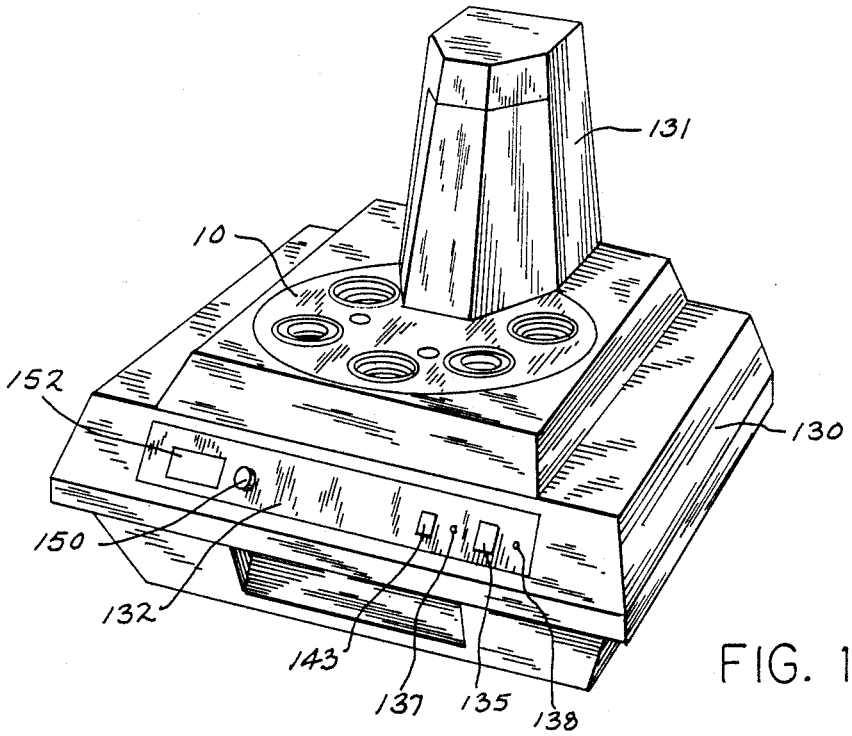
FIG. 1 is a view in perspective of a button press in accordance with this invention.

As shown in FIG. 1, the button press has a housing 130 which surrounds the entire mechanism except for the turntable 10. A removable upright shroud 131 covers the upper die assembly 55 and the mechanism for reciprocating that assembly. A control panel 132 is provided on the front of the housing 103.

Figure 11:
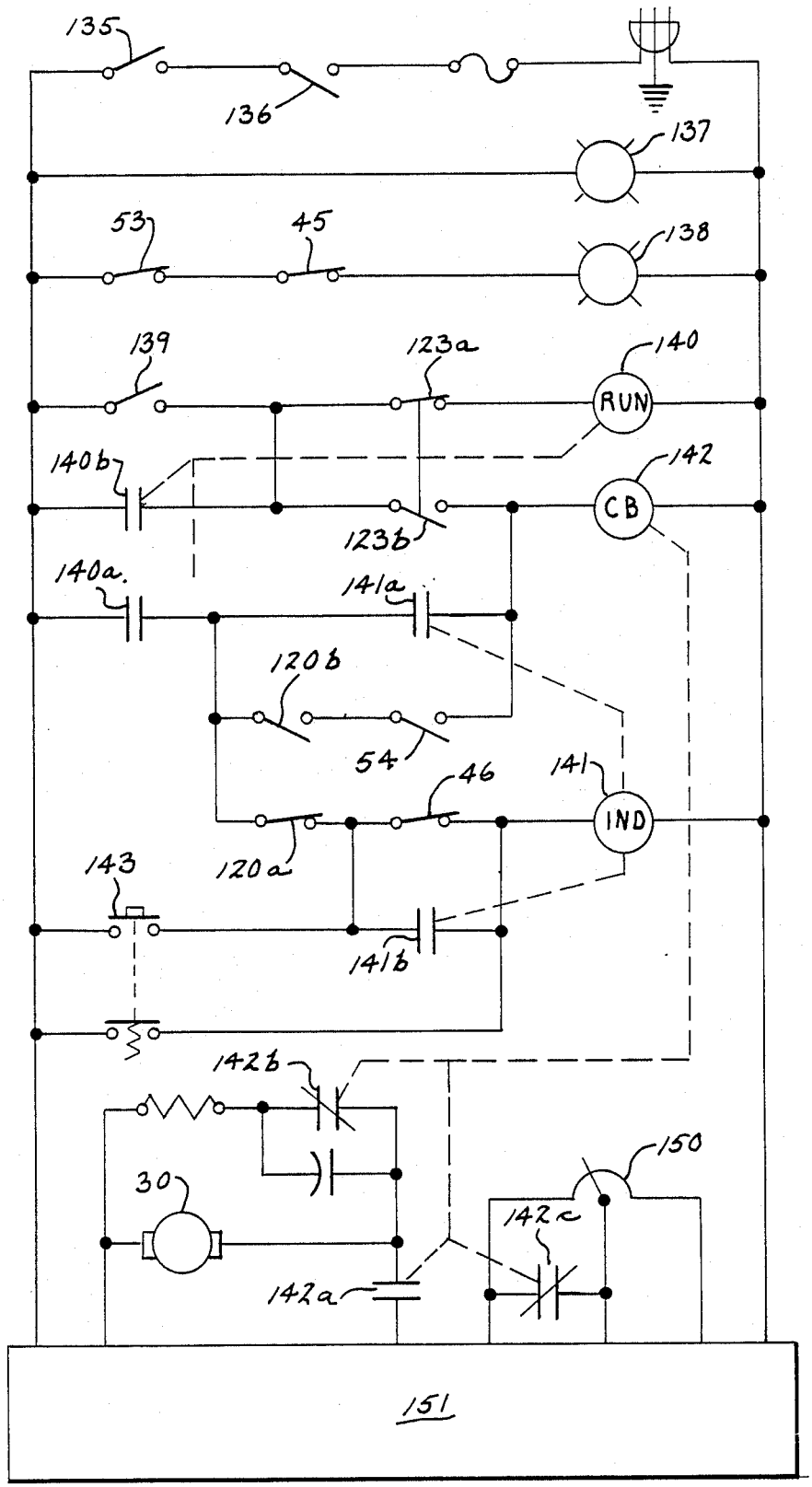
FIG. 11 is a schematic diagram of the electrical control for the button press drive.

Referring to FIG. 11, power to the motor 30 and to the control for the motor can be provided when both an on-off power switch 135 and a housing switch 136 are closed. The on-off switch 135 is located on the control panel 132. The housing switch 136 is closed whenever the housing 130 is in place. With those two switches closed, a power-on light 137 on the control panel will be illuminated. Also, if the index wheel 28 and the table 10 are both in an indexed position as sensed by the table position switch 53 and the index detent switch 45, those switches will be closed and an alignment light 138 on the control panel will be illuminated thereby indicating that the mechanisms are in vertical alignment. If an operator foot switch 139 is thereafter closed, a circuit is completed through the normally closed contacts **123*a* of the end-of-cycle switch 123 to energize a run relay 140. This will cause the closing of normally open relay contacts 140*a* to complete a circuit through normally closed contacts 120*a* of the press-index switch 120 and the index detent switch 46 to thereby energize an index relay 141. This will close index relay contacts 141*a* and 141*b*. Closing of the former will complete a circuit through the now closed run relay contacts 140*a* to a clutch-brake relay 142 thereby closing relay contacts 142*a* to energize the motor 30 and at the same time opening relay contacts 142*b* to remove the brake from the motor 30. The motor will then begin to drive the mechanisms. Closing of the index relay contacts 141*b* will provide an alternative circuit to maintain the index relay 141 energized even after the index detent switch 46 is opened as the index wheel 28 begins to rotate. So long as the foot switch 139 is held closed, the clutch-brake relay 142 will be continuously energized to drive the motor 30 and thereby to continuously index the turntable 10 and reciprocate the upper die assembly 55** in a coordinated manner.

Should the operator release the foot switch 139, the control will continue to complete an indexing of the turntable so that the mechanisms are in alignment for subsequent use. This is accomplished by the press index switch 120. The press index switch contacts **120*a* will open during a portion of each cycle while the other contacts 120*b* of the press-index switch will close. Opening of the contacts 120*a* of the press-index switch will open the circuit to the index relay 141 and thereby open the contacts 141*a* which provided one of the circuit paths to the clutch-brake relay 142. Contacts 120*a* of the press-index switch are closed during approximately one half revolution of the cam 122. During the remainder of a full turn of the cam 122, contacts 120*a* are open and contacts 120*b* are closed and indexing is not occurring. At this time, table position switch 54 is closed insuring that upper and lower dies are aligned for a press cycle. The latched run relay 140 causes this cycle to complete if the foot switch opens. The run relay 140 would then be unlatched by the momentary function of the end-of-cycle switch 123 at the end of a pressing function. An alternate circuit to the clutch-brake relay 142 is provided through the closed contacts 120*b* of the press-index switch 120 and through the table position switch 54 which will be closed when the table is in an indexed position. Thus, a circuit is continued to energize the motor 30 until the table is indexing, at which time the table position switch 54** will be open.

The run relay 140 is deenergized momentarily at the end of each half of a complete cycle when the end-of-cycle switch contacts **123*a* are momentarily opened. This does not halt the operation of the motor 30 by the clutch-brake relay 142 so long as the foot switch remains closed since a circuit is completed to that relay 142 through the momentarily closed contacts 123*b* of the end-of-cycle switch 123**.

If the mechanism should halt operation prior to the completion of an indexing operation, as by a sudden power failure, it is necessary to close a restart switch 143 which provides an alternate path to energize the index relay 141 to rotate the index wheel 38 until the index detent switch 46 is closed to again establish the normal circuit for the index relay 141.

The button press may be provided with a speed control for the motor 30. As shown in FIG. 11, the speed is adjusted by a speed potentiometer 150 which controls a commercially available adjustable speed control 151, such as the Model MM21000 adjustable speed control available from Minarik Electric Company, Los Angeles, Calif. The speed control 151 is continuously energized upon closure of the on-off power switch 135 and the housing switch 136. The closing of relay contacts **142*a* of the clutch-brake relay 142 pass current to the motor 30. When the clutch-brake relay 142 is deenergized, the contacts 142*b* close to connect a braking resister to the motor armature. The speed of the motor 30 is proportional to the setting of the potentiometer 150. When contacts 142*b* close, contacts 142*c* also close causing a zero speed over-ride of the potentiometer 150**. This prevents eratic speed upon start of a cycle.

The button press may also be provided with a battery-operated counter 152 mounted on the control panel and which is actuated by a switch (not shown) that is closed once for each two increments of indexing of the turntable 10 corresponding to the assembly of one complete button.

During normal automatic operation, the operator sets the speed at which he or she is comfortable and closes the foot switch. The operator loads the components into the lower die assemblies 11 and 12 that will be advanced beneath the upper die assembly 55 and removes the completed buttons from the crimping die assemblies 12 after they exit from beneath the shroud 131.

I claim:

1. A button press, comprising:

an upper die assembly mounted on a ramrod journaled for vertical movement in a support;

an indexable turntable mounted on a vertical shaft journaled in a support, said turntable mounting a plurality of spaced, alternating lower forming die assemblies and crimping die assemblies positionable beneath the upper die assembly;

a motor drive driving a sprocket;

a linkage connecting the sprocket to the ramrod to translate the rotation of the sprocket to reciprocating linear movement of the ramrod; and an intermittent right angle drive connecting the sprocket to the vertical shaft.

2. A button press in accordance with claim 1 wherein the right angle drive comprises an index wheel mounted on the vertical shaft and including a plurality of spaced radial slots in its perimeter, and a drive roller connected to the sprocket and movable thereby through a conical path that intersects the perimeter of the index wheel and engages the sides of successive radial slots.

3. A button press, comprising:

an upper die assembly mounted for vertical movement on a support;

an indexable turntable journaled on a support and mounting a plurality of spaced, alternating lower forming die assemblies and crimping die assemblies positionable beneath the upper die assembly as the turntable indexes;

means for moving the upper die assembly toward and away from engagement with a respective lower die assembly;

means for indexing the turntable through finite increments each corresponding to the space between successive lower dies;

common drive means for the moving means and indexing means to cause the upper die assembly to move toward and away from a respective lower die assembly following each increment of indexing of the turntable; and said means for indexing the turntable comprising an index wheel mounted on a shaft which also mounts the turntable, said index wheel including a plurality of spaced radial slots in its perimeter, and a drive roller connected to the drive means and movable thereby through a conical path that intersects the perimeter of the index wheel and engages successive radial slots.

4. A button press in accordance with claim 3 wherein the drive roller is mounted on a crank arm on a shaft driven by the drive means, and the axis of the drive roller, of the driven shaft, and of the turntable shaft intersect at a point.

5. A button press in accordance with claim 3 wherein the turntable is mounted to the turntable shaft, by a releasable clutch.

6. A button press in accordance with claim 5 wherein the releasable clutch includes a plurality of spring loaded balls mounted to rotate with the turntable shaft and a plurality of recesses formed in the turn table to be engaged by the balls, said engagement constituting the driving connection between the shaft and turntable.

7. A button press in accordance with claim 3 wherein the moving means for the upper die assembly comprises a ramrod mounting the upper die assembly and journaled in the support, a walking beam pivoted intermediate its ends to the support, one end of the walking beam being connected to the ramrod, and a link connecting the other end of the walking beam to the drive means.

8. A button press in accordance with claim 7 wherein the link comprises a pair of connecting rods, one telescoped within the other and joined by a tension spring whereby the rods act as a solid linkage during upward travel of the rods and the rods can separate axially against the spring tension during downward travel of the rods.

9. A button press in accordance with claim 7 wherein the link is connected to the face of a driven sprocket eccentric of the axis of rotation of the sprocket, and the sprocket is rotated by the drive means to translate the rotation of the sprocket into linear motion of the link.

10. A button press in accordance with claim 9 wherein the driven sprocket drives a shaft that indexes the turntable.

11. A button press, comprising:

an upper die assembly for vertical movement on a support;

an indexable turntable journaled on a support and mounting a plurality of spaced, alternating lower forming die assemblies and crimping die assemblies positionable beneath the upper die assembly as the turntable indexes;

means for moving the upper die assembly toward and away from engagement with a respective lower die assembly;

means for indexing the turntable through finite increments each corresponding to the space between successive lower dies;

common drive means for the moving and indexing means to cause the upper die assembly to move toward and away from a respective lower die assembly following each increment of the indexing of the turntable; and said means for indexing the turntable comprising an index wheel mounted on a shaft which also mounts the turntable, said index wheel including a plurality of spaced radial slots in its perimeter, and a drive roller connected to the drive means and movable thereby through a conical path that intersects the perimeter of the index wheel and engages successive radial slots; and a spring loaded detent roller adapted to engage a respective radial slot in the index wheel to normally hold the turntable in a position where one of the lower die assemblies is aligned beneath the upper die assembly.

* * * * *